235-379
2/26/85 XR 4,501,416

United States Patent [19]

Hain

[11] Patent Number: 4,501,416

[45] Date of Patent: Feb. 26, 1985

[54] SHEET HANDLING APPARATUS

[75] Inventor: David A. Hain, Dundee, Scotland

[73] Assignee: NCR Corporation, Dayton, Ohio

[21] Appl. No.: 369,781

[22] Filed: Apr. 19, 1982

[30] Foreign Application Priority Data

Nov. 10, 1981 [GB] United Kingdom ..... 8133823

[51] Int. Cl.[3] ..... B65H 3/12

[52] U.S. Cl. ..... 271/3.1; 271/8 A; 271/9; 271/95; 271/163; 209/534; 194/4 C; 235/379

[58] Field of Search ..... 271/9, 3.1, 8 A, 95, 271/91, 101, 163; 209/534; 235/379; 194/4 C, 4 R

[56] References Cited

U.S. PATENT DOCUMENTS

| | | | |
|---|---|---|---|
| 2,810,575 | 10/1957 | Holmen | 271/27 |
| 2,911,216 | 11/1959 | Richardson | 271/27 |
| 2,912,242 | 11/1959 | Richardson | 271/27 |
| 3,005,632 | 10/1961 | Orner | 271/163 |
| 3,597,594 | 8/1971 | Evans | 235/92 SB |
| 3,608,690 | 9/1971 | Morrow | 194/4 C |
| 3,791,392 | 2/1974 | Hanson | 133/1 R |

FOREIGN PATENT DOCUMENTS

| | | | |
|---|---|---|---|
| 0024704 | 3/1981 | European Pat. Off. | 194/4 C |
| 967491 | 10/1960 | United Kingdom . | |
| 1195724 | 6/1970 | United Kingdom . | |
| 1301759 | 1/1973 | United Kingdom . | |
| 1354393 | 5/1974 | United Kingdom . | |
| 1432438 | 4/1976 | United Kingdom . | |

*Primary Examiner*—Richard A. Schacher
*Attorney, Agent, or Firm*—Albert L. Sessler, Jr.; Elmer Wargo

[57] ABSTRACT

A sheet handling apparatus which may be used for loading currency notes 70 into, and removing currency notes from, a cassette 68 includes a vacuum-operated, rotating pick-up wheel assembly 16 having two pairs of pick-up wheels 18 and 22. The pick-up wheels can operate to carry notes one by one from a loading station 98 and load them into an open end of the cassette 68, or can operate to pick up notes one by one from the open end of the cassette and carry them to a release station 118. A solenoid-operated control means is provided for switching the apparatus from a loading mode of operation to a pick-up mode, and vice versa, the control means serving to control the application of vacuum to the pick-up wheels and the operation of associated elements such as note retaining pawls 74. The apparatus may be used in an automatic bank teller system.

14 Claims, 14 Drawing Figures

FIG. 6A
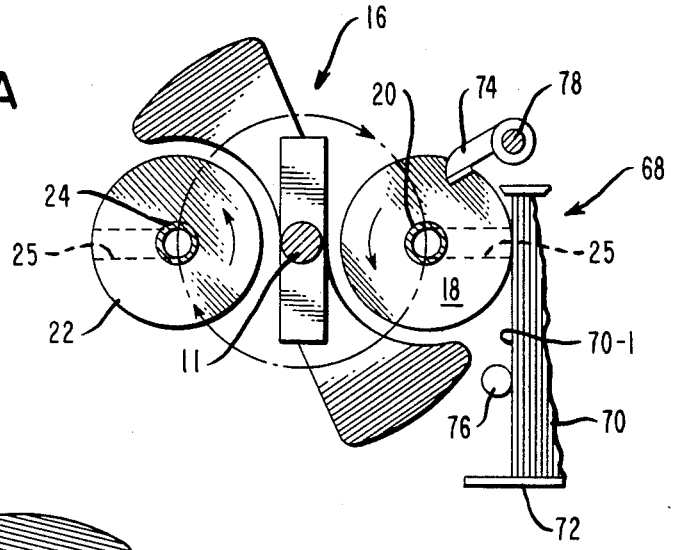
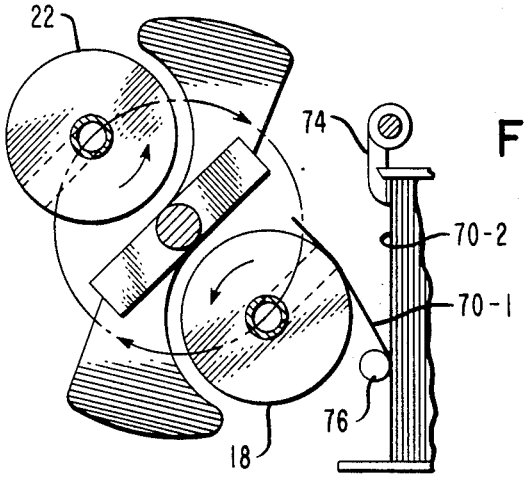
FIG. 6B
FIG. 6C
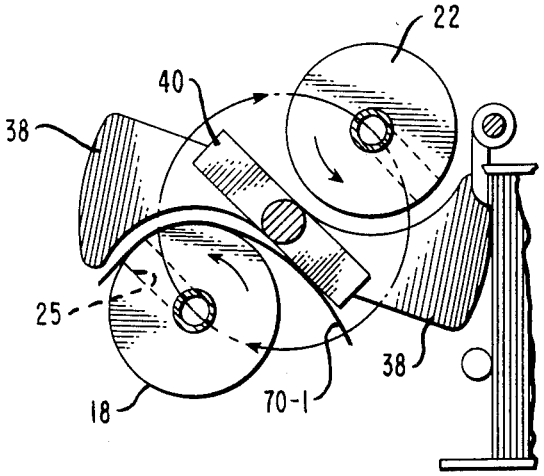

SHEET HANDLING APPARATUS

BACKGROUND OF THE INVENTION

This invention relates to a sheet handling apparatus which may be used for loading currency notes into, and removing currency notes from, a holding means.

This invention has application, for example, to an automatic bank teller machine of the kind wherein a user inserts a customer identifying card into the machine and then enters certain data (such as codes, amount of cash required or to be paid in, type of transaction, etc.) upon a keyboard associated with the machine, and inserts into the machine any currency notes to be paid in. The machine will then process the transaction, update the user's account to reflect the current transaction, dispense cash if necessary, and return the card to the user and issue a transaction record slip as part of a routine operation.

Known teller machines of the kind specified normally only accept cash to be deposited when the cash is placed in an envelope or other suitable container, identifying information being written or printed on the outside of the container. The deposited container is subsequently opened and the contents checked by a bank employee. A drawback of such teller machines is that cash deposited in the machine by one customer is not available for paying out by the machine to another customer, and so it is necessary for the machine to be replenished with cash at fairly frequent intervals.

In U.K. Patent Specification No. 1,354,393 there is disclosed an automatic bank teller machine including means for automatically checking and counting cash paid into the machine and delivering into a safe currency notes and coins determined to be genuine. The machine also includes means for supplying to a cash delivery port cash obtained from the safe. However, there is no clear disclosure in this specification that cash paid into the machine by one customer can be used for paying out to another customer. Also, the specification gives no details of how currency notes are stacked in the safe or removed therefrom.

SUMMARY OF THE INVENTION

It is an object of this invention to provide a sheet handling apparatus which has the capability of loading sheets, such as currency notes, into a holding means and of removing from the holding means sheets loaded into it by the apparatus.

It is a further object of this invention to provide a sheet handling apparatus which has the above capability and which has a compact and simple form of construction.

According to this invention there is provided a sheet handling apparatus including pick-up means arranged to remove sheets one by one from a stack of sheets held in holding means and to carry each sheet to a sheet release station, the pick-up means being movable into engagement with the first sheet of the stack at one end of said holding means for the purpose of removing a sheet from the stack, and the pick-up means being arranged also to load sheets one by one into said holding means at said one end, said apparatus including mode selection means operable to determine whether the apparatus is to operate in a sheet pick-up mode or a sheet-loading mode, and control means responsive to said mode selection means for controlling the operation of said pick-up means whereby said pick-up means is arranged to pick up the first sheet of the stack from said holding means and release it at said sheet release station when the apparatus is operating in the sheet pick-up mode, and is arranged to pick up a sheet at a loading station and release it at said one end of said holding means next to the first sheet of the stack when the apparatus is operating in the sheet-loading mode.

The sheet handling apparatus of this invention has a compact and simple form of construction by virtue of the use of a common mechanism for both loading sheets into, and removing sheets from, the holding means for the sheets.

The above advantages and others will be more readily understood in connection with the following description, claims, and drawing.

BRIEF DESCRIPTION OF THE DRAWING

FIGS. 6A to 6H are schematic views showing different stages in the loading and pick-up modes of operation of the currency note handling apparatus.

DETAILED DESCRIPTION OF THE INVENTION

Figure 1:
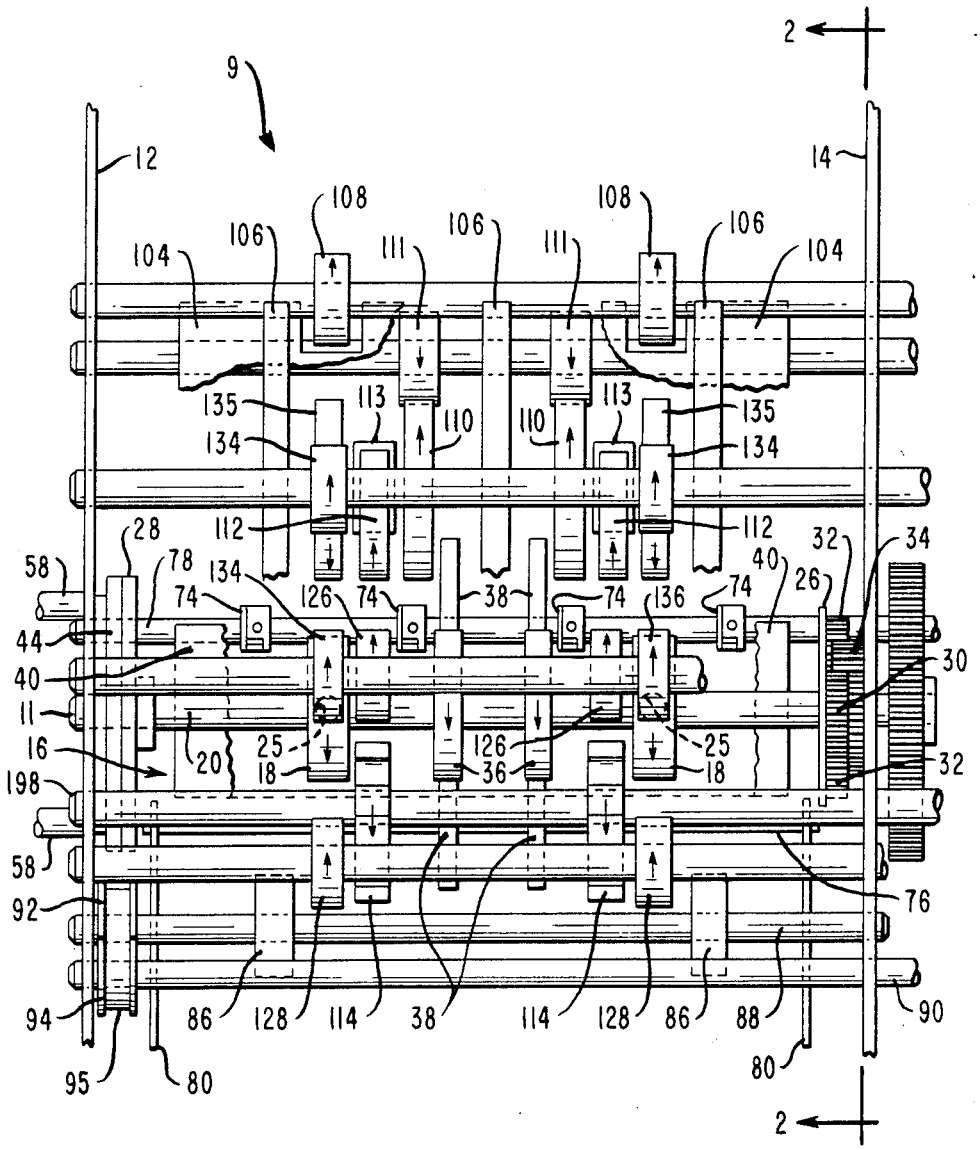
FIG. 1 is an end elevational view of a currency note handling apparatus of this invention showing a picker/-loader mechanism for loading currency notes into and picking currency notes from a cassette.
Figure 2:
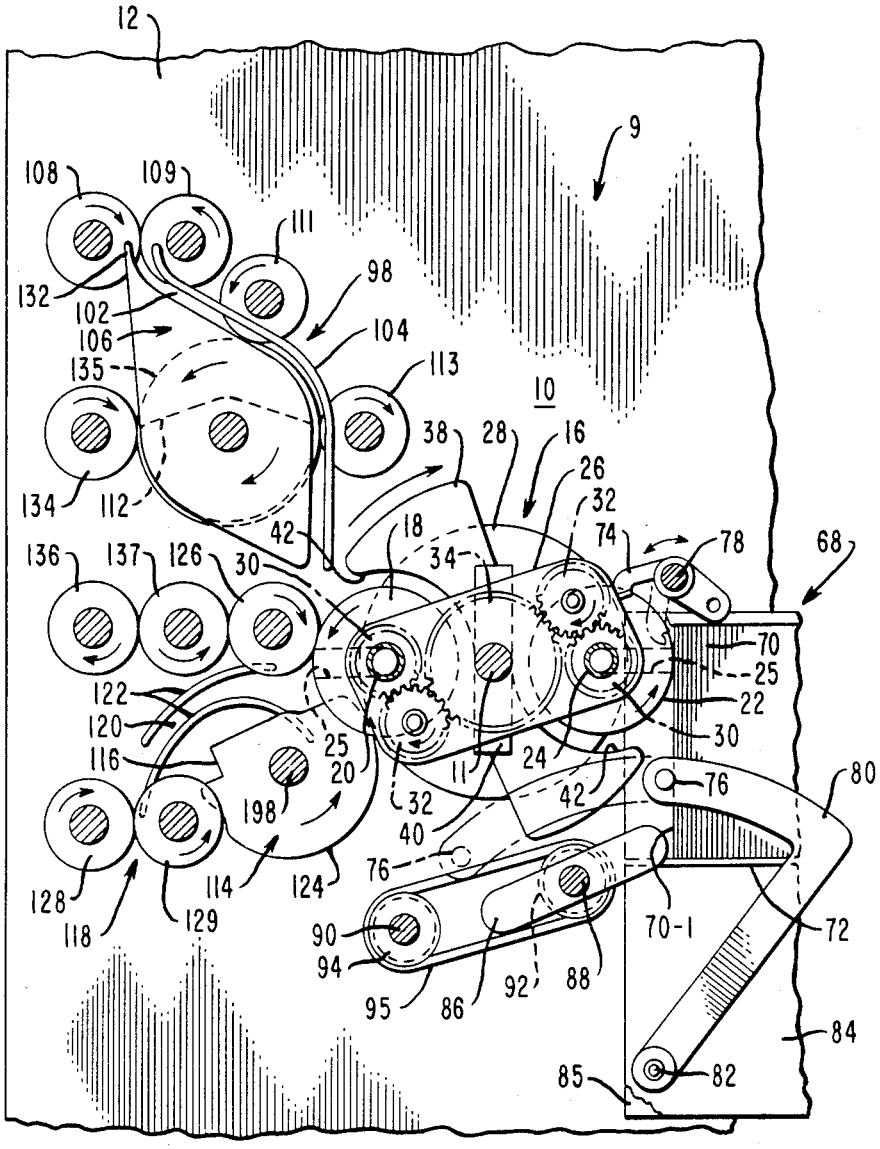
FIG. 2 is a side elevational view of the apparatus shown in FIG. 1, the view being taken along the line 2—2 of FIG. 1.

Referring first to FIGS. 1 and 2 of the drawings, the currency note handling apparatus designated generally as 9 and shown therein includes a picker/loader mechanism 10 having a central drive shaft 11 which is mounted between two fixed, parallel side plates 12 and 14 and which is driven by an electric motor (not shown). A pick-up wheel assembly 16 is mounted on the drive shaft 11. The assembly 16 includes a first pair of pick-up wheels 18 mounted on a hollow shaft 20, and a second pair of pick-up wheels 22 mounted on a hollow shaft 24. On the circumference of each of the pick-up wheels 18 and 22 there is provided an opening 25 which communicates with the interior of the relevant hollow shaft and via which vacuum may be applied to a currency note to be picked up by the wheel 18 or 22, as will be described later. Each of the hollow shafts 20 and 24 extends between, and is rotatably mounted on, a support plate 26 and a flange member 28 which form part of the assembly 16. Two gear wheels 30 are respectively provided at corresponding ends of the shafts 20 and 24, each of the gear wheels 30 meshing with a respective idler gear wheel 32 which is rotatably mounted on the support plate 26. The idler gear wheels 32 both mesh with a fixed gear wheel 34 secured to the side plate 14. Thus, it will be appreciated that, as the pick-up wheel assembly 16 rotates in a clockwise direction with reference to FIG. 2, the hollow shafts 20 and 24 and the pick-up wheels 18 and 22 mounted thereon are caused to rotate in a counterclockwise direction by means of the two gear trains formed by the gear wheels 30, 32, and 34. By virtue of this arrangement, the pick-up wheels 18 and 22 rotate in a planetary motion about the axis of the assembly 16. The gear ratios are such that each pick-up wheel 18 or 22 rotates once about its own axis for each complete rotation of the assembly 16. Two guide rollers 36 (FIG. 1) are mounted on each of the hollow shafts 20 and 24. Each of the guide rollers 36 is associated with a respective guide member 38 mounted on a guide plate 40, the plate 40 being mounted on the central drive shaft 11 for rotation therewith. The guide members 38 are each provided with an arcuate guide surface 42 which faces, and is spaced from, the respective guide roller 36.

Figure 3:
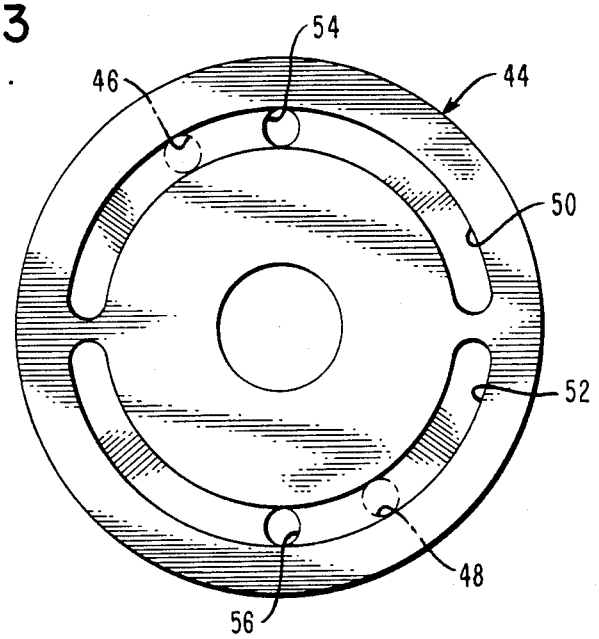
FIG. 3 is an enlarged view of a thrust flange member forming part of the picker/loader mechanism.

Referring now also to FIG. 3, the currency note handling apparatus 9 includes a vacuum control system including the flange member 28 (FIG. 1) mounted on the central drive shaft 11, and a fixed thrust flange member 44 mounted on the side plate 12. The flange members 28 and 44 are mounted in side-by-side relationship with their adjacent faces being flat and in sliding contact with each other. Corresponding ends of the hollow shafts 20 and 24 are secured in the flange member 28 and respectively communicate with circular openings 46 and 48 (FIG. 3) formed in that face of the member 28 adjacent the thrust flange member 44. The other ends of the shafts 20 and 24 are closed. That face of the thrust flange 44 adjacent to the member 28 is provided with two arcuate ducts 50 and 52 which respectively communicate with two inlet ports 54 and 56 formed in the opposite face of the member 44. The ducts 50 and 52 are so positioned that, as the flange member 28 rotates in operation, each duct 50 or 52 communicates alternately with the openings 46 and 48 formed in the member 28.

Figure 5:
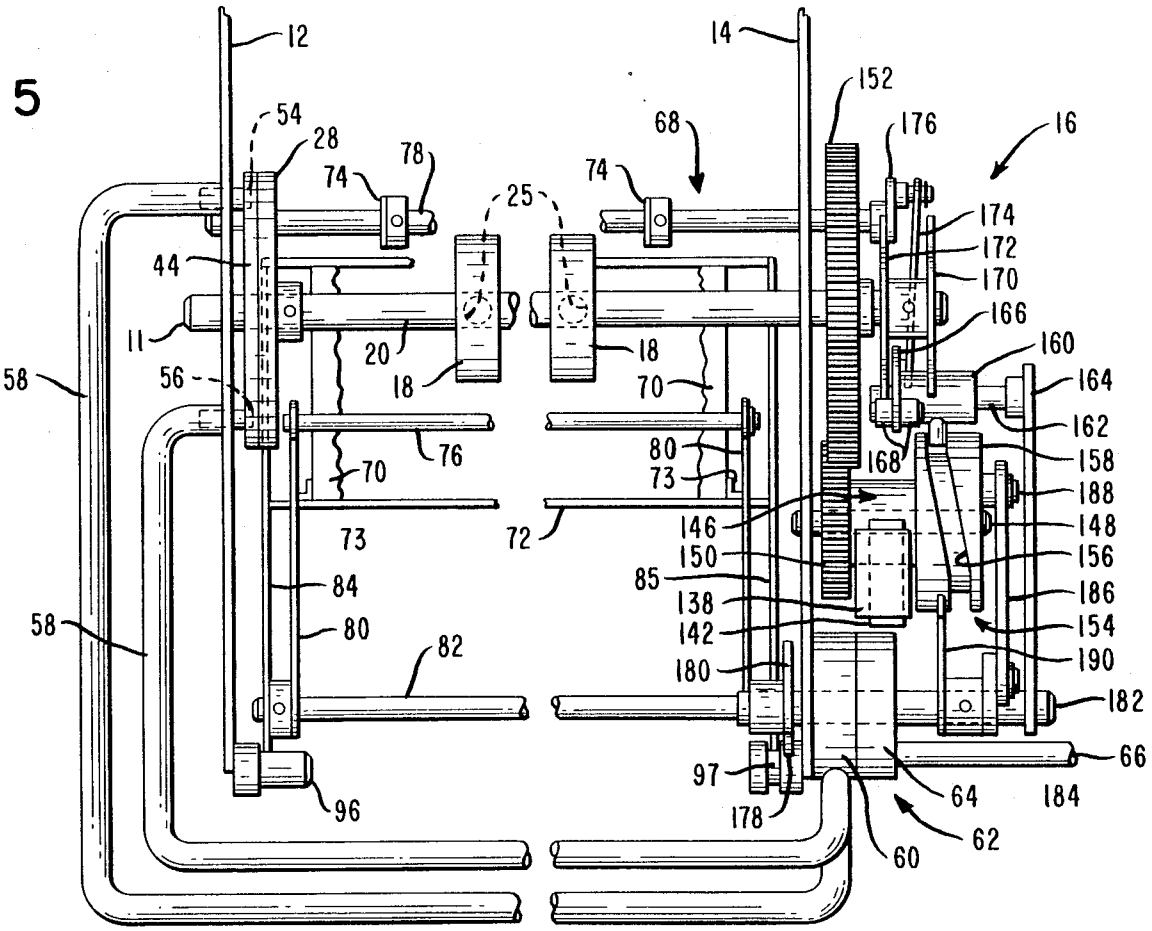
FIG. 5 is an end elevational view of the control system shown in FIG. 4, the view being taken along the line 5—5 of FIG. 4 and additionally showing parts of the picker/loader mechanism.

As shown in FIG. 5, the inlet ports 54 and 56 are respectively connected via two tubes 58 to a fixed portion 60 of a vacuum valve 62, a movable portion 64 of the valve 62 being connected via a tube 66 to a vacuum source (not shown). As will be described later, the portion 64 is settable to one or the other of two positions, the particular position to which it is set determining whether vacuum is applied to the inlet port 54 or to the inlet port 56. It will be appreciated that, in operation, vacuum will be applied alternately to the pair of pick-up wheels 18 (via the hollow shaft 20) and to the pair of pick-up wheels 22 (via the hollow shaft 24), the timing of the application of vacuum to the two pairs of pick-up wheels being changed when the position of the movable portion 64 of the vacuum valve 62 is changed. Thus, if vacuum is applied to the inlet port 54, then vacuum is applied to the pair of pick-up wheels 18 when the opening 46 (FIG. 3) is in communication with the duct 50, and vacuum is applied to the pair of pick-up wheels 22 when the opening 48 is in communication with the duct 50; if vacuum is applied to the inlet port 56, then vacuum is applied to the pair of pick-up wheels 18 when the hole 46 is in communication with the duct 52 and vacuum is applied to the pair of pick-up wheels 22 when the hole 48 is in communication with the duct 52.

Figure 4:
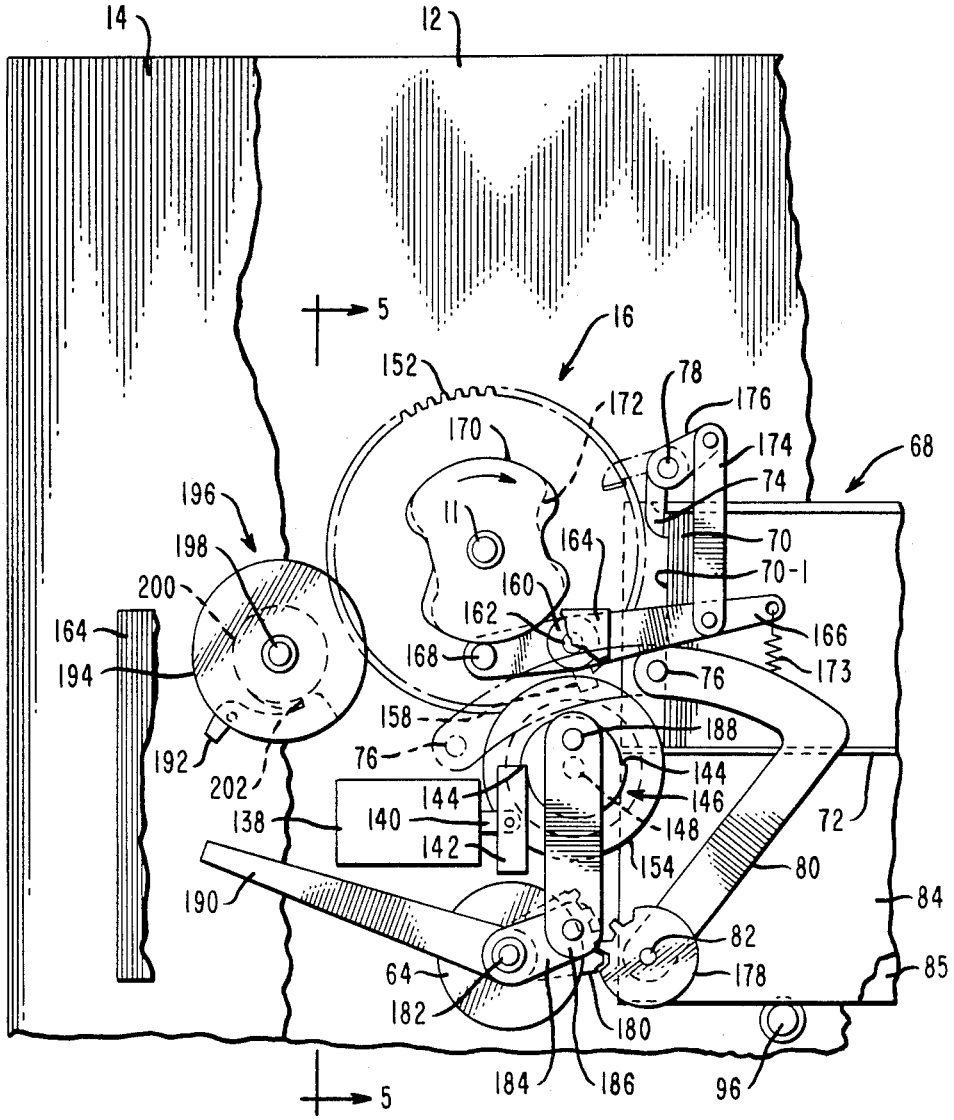
FIG. 4 is a side elevational view of a control system for controlling the mode of operation of the picker/-loader mechanism.

Referring now also to FIGS. 4 and 5, the pick-up wheel assembly 16 is positioned adjacent an open end of a cassette 68 (not shown in FIG. 1) which in operation is arranged to hold a stack of currency notes 70 supported on a base plate 72 of the cassette 68. The cassette 68 can be adjusted to accommodate currency notes 70 of different sizes; for this purpose the vertical position of the base plate 72 is adjustable, and also the upper surface of the base plate 72 is provided with two adjustable guide members 73 (FIG. 5) which engage the side edges of the stack of notes 70 in the cassette 68. The currency notes 70 are urged towards the pick-up wheel assembly 16 by means of a spring-loaded pusher plate (not shown).

As shown in FIG. 4, the first currency note 70-1 in the stack is normally engaged by a plurality of retaining pawls 74 and a retaining rod 76 so as to hold the stack of notes in position in the cassette 68. The pawls 74 are mounted on, and spaced apart along, a shaft 78 which is rotatably mounted between the side plates 12 and 14. The retaining rod 76 is mounted between ends of a pair of generally L-shaped support arms 80, the other ends of the arms 80 being secured to a shaft 82 which is mounted between side portions 84 and 85 (FIG. 5) of the cassette 68. The pawls 74 are pivotable between the position shown in solid outline in FIG. 4 (in which the free ends of the pawls are in engagement with the first note 70-1 in the stack) and that shown in solid outline in FIG. 2 (in which the free ends of the pawls are in their furthest position away from the cassette 68), and the retaining rod 76 is pivotable between the position shown in solid outline in FIGS. 2 and 4 (in which the rod is in engagement with the first note 70-1) and that shown in dotted outline in FIGS. 2 and 4 (in which the rod is in its furthest position away from the cassette 68). The manner in which the pawls 74 and the retaining rod 76 are set to a particular one of their two possible positions will be described in detail later.

To assist in the loading of currency notes 70 into the cassette 68 there are provided two paddle members 86 (FIG. 2) mounted on a shaft 88 rotatably mounted between the side plates 12 and 14. The paddle members 86 are rotated continuously in operation by means of a drive shaft 90, with the drive from the shaft 90 being transmitted to the shaft 88 by means of pulleys 92 and 94, respectively, secured to the shafts 88 and 90, and also by means of a drive belt 95 which passes around the pulleys 92 and 94. As a currency note is loaded into the open end of the cassette 68, ends of the paddle members 86 strike the lower edge of the note and urge it into position in the cassette.

The cassette 68 (FIG. 5) is removably mounted in the picker/loader mechanism 10, with the bottom edges of the side portions 84 and 85 of the cassette being supported, respectively, on support members 96 and 97, which in turn are secured to the side plates 12, 14, respectively.

Referring again to FIGS. 1 and 2, associated with the picker/loader mechanism 10 is a loading station 98 to which currency notes are supplied from a hold station 100 (see FIG. 7) or from another similar picker/loader mechanism. During a loading operation, currency notes are arranged to be fed one by one from the hold station 100 (or other picker/loader mechanism) into a guideway 102 (FIG. 2) which forms part of the loading station 98 and which is formed between a fixed guide member 104 and pivotable gate members 106. The gate members 106 are positioned as shown in FIG. 2 during an operation for loading currency notes into the cassette 68. The notes are fed along the guideway 102 by means of co-operating feed rollers 108, 109; 110, 111; 112 and 113, the feed rollers rotating in the directions indicated by the arrows in FIGS. 1 and 2.

Figure 6H:
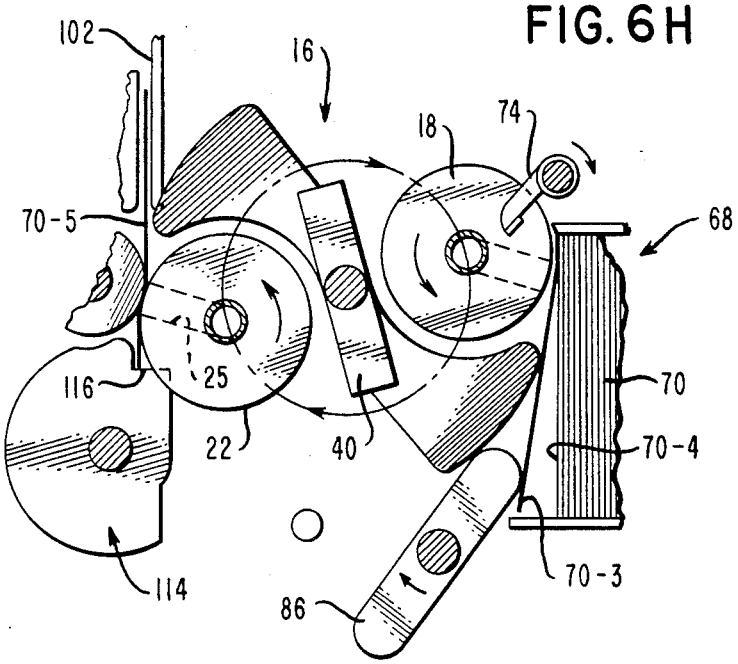

The rollers 112 are in the form of quadrant rollers, as shown in FIG. 2. Beneath the lower end of the guideway 102 there are positioned two pinch rollers 114 each having a shoulder 116 provided thereon. During a loading operation, the pinch rollers 114 are held stationary with the shoulders 116 (FIG. 6E) positioned directly beneath the lower end of the guideway 102. As shown in FIG. 6E, during an initial part of a loading operation, the leading edge of a currency note 70-3 to be loaded is supported on the shoulders 116, with the trailing edge of the note 70-3 being below the nip of the co-operating feed rollers 112, 113 so that no crumpling of the note takes place. The manner in which this note is loaded by the picker/loader mechanism 10 into the open end of the cassette 68 will be described in detail later.

Also associated with the picker/loader mechanism 10 is a release station 118 (FIG. 2) which includes the pinch rollers 114 and a guideway 120 formed between two fixed guide members 122 (omitted from FIG. 1 for the sake of clarity). During a picking operation, the pinch rollers 114 are rotated continuously, and currency notes are picked, one by one, by the picker/-loader mechanism 10 from the cassette 68 and fed towards the release station 118, in a manner to be described later. Upon reaching the release station 118, each note is gripped between a feed surface 124 (FIG. 2) of each pinch roller 114 and a co-operating feed roller 126 and fed along the guideway 120 to further co-operating feed rollers 128 and 129 from where the note is fed to a double detect device 130 (see FIG. 7) or to another similar picker/loader mechanism.

Solenoid operated means (not shown) are provided for pivoting the gate members 106 between the position shown in FIG. 2 and a position in which their upper ends 132 are disposed to the right of the feed rollers 108 (with reference to FIG. 2). By adjusting the gate members 106 to this last-mentioned position, currency notes fed to the feed rollers 108, 109 are caused to bypass the picker/loader mechanism 10 and instead are fed by means of co-operating feed rollers 134 and 135, and 136 and 137 directly to the feed rollers 128 and 129 of the release station 118. By virtue of this bypass arrangement, currency notes from the hold station 100 (FIG. 7) can be loaded into a selected one of a number of separate cassettes 68-1 to 68-*n* as will be described later with reference to FIG. 7.

Referring now particularly to FIGS. 4 and 5, the currency note handling apparatus includes a control system whereby the apparatus can be switched from operating in a pick-up mode (i.e. picking currency notes 70 one by one from the cassette 68 and releasing them at the release station 118) to operating in a loading mode (i.e. loading currency notes 70 one by one into the cassette 68), and vice versa.

The control system includes an operation mode control solenoid 138 (FIG. 4) having an armature 140 on the end of which is mounted a pawl 142. The pawl 142 is normally arranged to engage one or the other of two shoulders 144 provided on a wrap spring clutch 146 so as to prevent rotation of the clutch 146. The clutch 146 is mounted on a shaft 148 extending from, and rotatably mounted on, the side plate 14. The shaft 148 is driven by a gear wheel 150 (FIG. 5) which in turn is driven by a gear 152 mounted on the central drive shaft 11. A cylindrical cam 154 is attached to the clutch 146. Upon the solenoid 138 being pulsed, the pawl 142 is momentarily released from engagement with one of the shoulders 144, so as to permit the clutch 146 and the cylindrical cam 154 to rotate through 180° before the clutch 146 is again stopped by virtue of the pawl 142 engaging the other one of the shoulders 144. A cam track 156 is formed on the circumference of the cam 154.

A cam follower 158 (FIG. 5) which engages the track 156 is mounted on a hub 160 which is slidably mounted on a stud 162 so as to be movable along the stud 162. The stud 162 is mounted on a fixed support plate 164. Rotatably mounted on the stud 162 is an arm 166 (FIG. 5) which is attached to the hub 160 for movement therewith along the stud 162. The arm 166, at one end, carries two cam follower rolls 168 which are respectively engageable with two cams 170 and 172 mounted on the drive shaft 11. One or the other of the rolls 168 is urged into engagement with the relevant cam 170 or 172 by means of a spring 173 attached to that end of the arm 166 which is remote from the rolls 168. A rotation through 180° of the cylindrical cam 154, brought about by pulsing of the solenoid 138 (FIG. 4) causes the hub 160 to be moved axially along the stud 162 (due to movement of the follower 158 along the track 156) and thereby brings a selected one of the rolls 168 into engagement with the associated cam 170 or 172. A portion of the arm 166, (FIG. 4) remote from the follower rolls 168, is connected by means of link members 174 and 176 to the shaft 78 on which are mounted the retaining pawls 74, whereby rotation of the arm 166 brings about rotation of the shaft 78 in a corresponding direction. It will be appreciated that movement of the retaining pawls 74 into and out of engagement with the first note 70-1 of the stack of notes 70 in the cassette 68 is controlled by that one of the cams 170 and 172 which is in engagement with the respective roll 168. It will further be appreciated that the timing of the operation of the pawls 74 can be changed by pulsing the solenoid 138 so as to bring the other one of the cams 170 and 172 into engagement with the respective roll 168, such change in timing being necessary when the apparatus changes from a pick-up mode of operation to a loading mode, or vice versa.

The means for adjusting the position of the retaining rod 76 (FIGS. 2, 4) for the currency notes 70 will now be described. The shaft 82 on which are mounted the support arms 80 for the rod 76 has secured to it a gear segment 178. The gear segment 178 meshes with a gear segment 180 secured on a shaft 182 rotatably mounted on, and extending between, the side plate 14 and the support plate 164 (FIG. 5). The shaft 182 is connected by link members 184 and 186 to a stud 188 (FIG. 5) secured to the cylindrical cam 154, the arrangement being such that rotation of the cam 154 from one of its home positions to the other causes the shaft 182 to be rotated from one angular position to another. Rotation of the shaft 182 and the gear segment 180 from their positions shown in FIG. 4 to their other angular positions (brought about by a 180° rotation of the cam 154) serves to bring the retaining rod 76 into the position shown in dotted outline in FIG. 4 in which it is spaced well away from the first note 70-1 in the cassette 68.

Also secured to the shaft 182 is one end of an arm 190 (FIGS. 4, 5) the free end of which is adapted to be engageable with a clutch pawl 192 pivotably mounted on a driven member 194 of a clutch 196 (which is omitted from FIG. 5 for the sake of clarity), the driven member 194 being secured on a shaft 198 on which are mounted the pinch rollers 114 (see also FIGS. 1 and 2).

The clutch 196 (FIG. 4) includes a continuously driven driver member 200; the arrangement is such that when the arm 190 is out of engagement with the clutch pawl 192 (corresponding to a pick-up mode of operation) the pawl 192 is in engagement with a shoulder 202 provided on the driver member 200 so that the shaft 198 and pinch rollers 114 mounted thereon continuously rotate, and that when the arm 190 is in engagement with the clutch pawl 192 (corresponding to a loading mode of operation) the pawl 192 is moved out of engagement with the shoulder 202, so that the pinch rollers 114 are held stationary in the position shown in FIG. 6E.

The shaft 182 (FIG. 5) also has mounted on it the movable portion 64 of the vacuum valve 62. Thus, it will be appreciated that rotation of the cam 154 through 180° brought about by pulsing the solenoid 138 (FIG. 4) serves to change the setting of the movable portion 64 of the valve 62 from one of its two positions to the other.

The operation of the note handling apparatus will now be described.

Firstly, the pick-up operation of the apparatus will be described. In this mode of operation the cylindrical cam 154 is set to the position shown in FIGS. 4 and 5 in which the stud 188 is positioned above the shaft 148; if the cam 154 is not in this position immediately prior to a pick-up operation, then the solenoid 138 is pulsed once to cause the clutch 146 to rotate through 180° and thereby bring the cam 154 into its desired position. With the cam 154 in this desired position, the following four settings have been effected: (1) The arm 190 is out of engagement with the clutch pawl 192 so that the driven member 194 of the clutch 196 rotates in a continuous manner, thereby causing the pinch rollers 114 (FIG. 2) to rotate in a continuous manner. (2) The support arms 80 are in the position shown in solid outline in FIG. 4 so that the retaining rod 76 is in engagement with the first currency note 70-1 of the stack of notes held in the cassette 68. (3) The left hand follower roll 168 (with reference to FIG. 5) is in engagement with the cam 172, this cam controlling the timing of the rotational movement of the retaining pawls 74 in a manner appropriate for a pick-up operation; for example, when the first currency note 70-1 is being picked from the cassette 68, the note-engaging ends of the pawls 74 are in their farthest positions away from the cassette 68. (4) The movable portion 64 of the vacuum valve 62 is set to a position in which vacuum is applied to the inlet port 56 via the relevant tube 58, the arrangement being such that vacuum is applied to the pick-up wheels 18 or 22 when the wheels are in contact with the first currency note 70-1 in the cassette 68, and that the vacuum source is disconnected from the pick-up wheels 18 or 22 when the wheels are adjacent the release station 118 (FIG. 2).

Referring now particularly to FIGS. 6A to 6D, the pick-up wheel assembly 16 is driven by the drive shaft 11 in a clockwise direction with each of the pick-up wheels 18 and 22 rotating in a counterclockwise direction. During an initial part of a pick-up operation, the openings 25 in the pair of pick-up wheels 18 come into engagement with the first note 70-1 in the cassette 68, as shown in FIG. 6A. As previously explained, at this time vacuum is applied to the openings 25 in the pick-up wheels 18, the note-engaging ends of the pawls 74 are in their farthest positions away from the cassette 68 (so as not to interfere with the picking up of the first note 70-1 from the cassette 68), and the retaining rod 76 is in engagement with the first note 70-1. As the pick-up wheel assembly 16 continues to rotate, the upper part of the first note 70-1 (FIG. 6B) is drawn away from the remainder of the notes 70 in the cassette 68 under the action of the vacuum applied to the note 70-1 via the openings 25 in the pick-up wheels 18. It should be understood that, by virtue of the planetary motion of the pick-up wheels 18 in which the wheels are rotating in a counterclockwise direction while their axes are moving in a clockwise direction, the pick-up wheels 18 make a rolling contact with the first note 70-1 whereby there is initially no relative sliding movement between the first note 70-1 and the adjacent note as the first note 70-1 is drawn away from the cassette 68. As a result of this rolling contact arrangement, the risk of double notes being picked from the cassette 68 by the pick-up wheels 18 is very considerably reduced.

Before the first currency note 70-1 has been drawn completely out of the cassette 68, the retaining pawls 74 have been rotated into a position in which they engage the next note 70-2 of the stack of currency notes 70 held in the cassette 68, as shown in FIG. 6B, and thereby retain the stack of notes in position. Continued rotation of the pick-up wheel assembly 16 causes the picked-up note 70-1 to be drawn by the pick-up wheels 18 from behind the retaining rod 76 and withdrawn completely from the cassette 68, the note 70-1 passing between the guide plate 40 and the guide members 38 on one side of the note and the pick-up wheels 18 and the guide rollers 36 (FIG. 1) on the other side of the note, as shown in FIG. 6C. At this stage, the note 70-1 is still held by the pick-up wheels 18 by virtue of continued application of vacuum to the pick-up wheels 18.

Figure 6D:
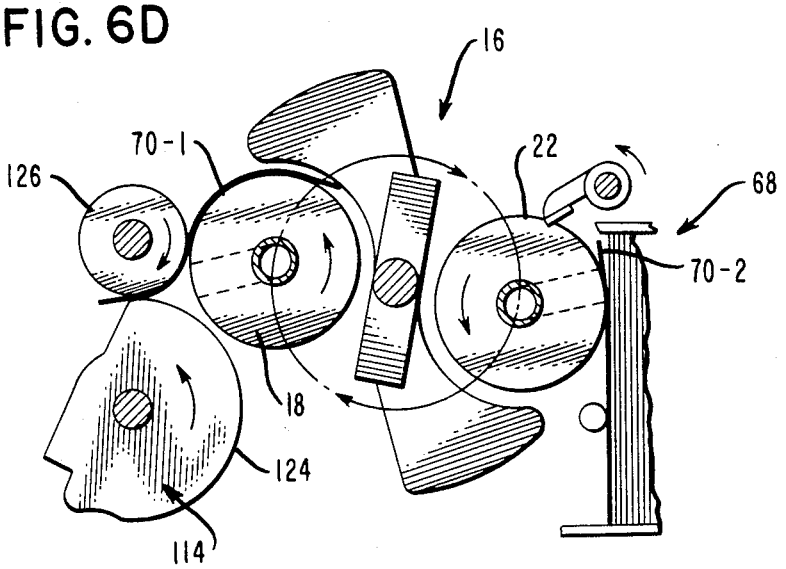
Figure 6E:
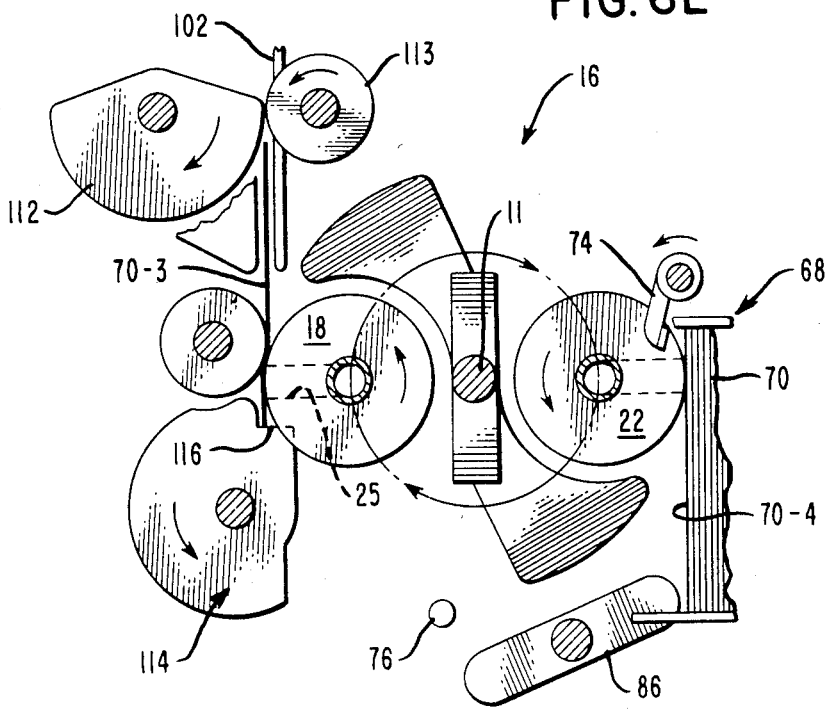

During a final part of a pick-up operation, the leading edge of the note 70-1 is gripped between the feed surface 124 of each pinch roller 114 and the cooperating feed roller 126 as shown in FIG. 6D. Immediately when the leading edge of the note 70-1 is so gripped, the application of vacuum to the pick-up wheels 18 is discontinued, as a result of the opening 46 (FIG. 3) in the flange member 28 moving out of communication with the arcuate duct 52. The note 70-1 is then fed by the pinch rollers 114 and the feed rollers 126 into the guideway 120 (FIG. 2) at the release station 118, and upon reaching the end of the guideway 120 the note 70-1 is gripped by the feed rollers 128, 129 and fed from there to the double detect device 130 (FIG. 7) or to another similar picker/loader mechanism. Immediately after the application of vacuum to the pick-up wheels 18 is discontinued, vacuum is applied to the openings 25 of the pick-up wheels 22, as a result of the opening 48 (FIG. 3) moving into communication with the arcuate slot 52. At this time the openings 25 of the pick-up wheels 22 are in engagement with the first one 70-2 of the notes 70 remaining in the cassette 68, and the pick-up wheels 22 commence to withdraw the note 70-2 from the cassette as shown in FIG. 6D, the pawls 74 having again been rotated such that their note-engaging ends are in their farthest positions away from the cassette 68. The note 70-2 is then withdrawn from the cassette 68 and carried to the release station 118 in a similar manner to that described above in relation to the note 70-1.

The loading operation of the note handling apparatus will now be described. In this mode of operation, the cylindrical cam 154 is set to the position in which the stud 188 is positioned below the shaft 148; i.e. the cam 154 is rotated through 180° from its position shown in FIGS. 4 and 5. If the cam 154 is not in its desired position prior to a loading operation, then the solenoid 138 is pulsed once to bring about a rotation of the cam 154 through 180°. With the cam 154 in its desired position for a loading operation, the following four settings have been effected: (1) The arm 190 has been rotated by the link members 184 and 186 to bring its free end into engagement with the clutch pawl 192 (FIG. 4) thereby causing the pinch rollers 114 to be held in a stationary condition with their shoulders 116 positioned directly below the lower end of the guideway 102 as shown in FIG. 6E. (2) The support arms 80 have been rotated by the gear segments 178 and 180 into a position in which the retaining rod 76 is in its furthest position away from the cassette 68, as shown in dotted outline in FIG. 4. (3) The right hand follower roll 168 (with reference to FIG. 5) has been moved into engagement with the cam 170, this cam controlling the timing of the rotational movement of the retaining pawls 74 in a manner appropriate for a loading operation. (4) The movable portion 64 (FIG. 5) of the vacuum valve 62 has been rotated by the shaft 182 to a position in which vacuum is applied to the inlet port 54 via the relevant tube 58, the arrangement being such that vacuum is applied to the pick-up wheels 18 or 22 when the wheels are adjacent the pinch rollers 114 (FIG. 2) and that the vacuum source is disconnected from the pick-up wheels 18 or 22 when the wheels are adjacent the cassette 68.

Also, prior to the commencement of a loading operation, the gate members 106 are set to the position shown in FIG. 2 in which they serve to direct currency notes fed to the feed rollers 108, 109 into the guideway 102. As previously described, each note entered into the guideway 102 is fed by the rollers 108 to 113 until the leading edge of the note abuts against the shoulders 116 of the pinch rollers 114 as shown in FIG. 6E.

Figure 6F:
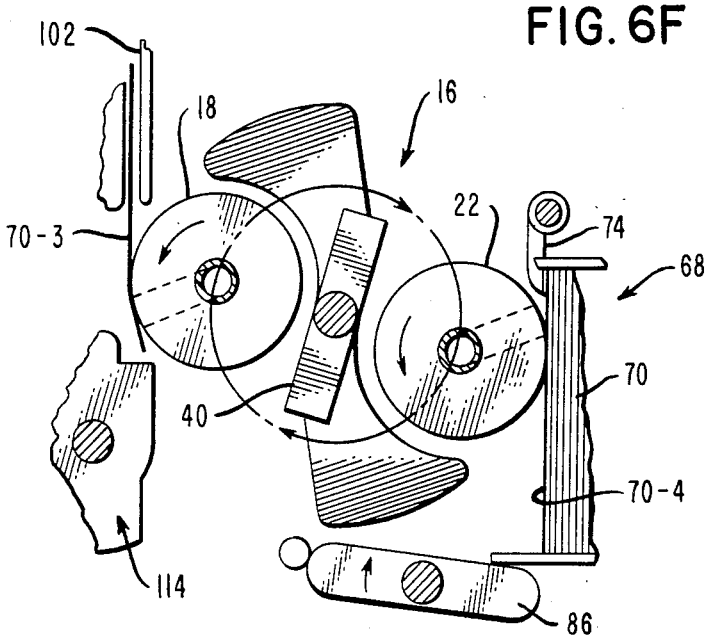
Figure 6G:
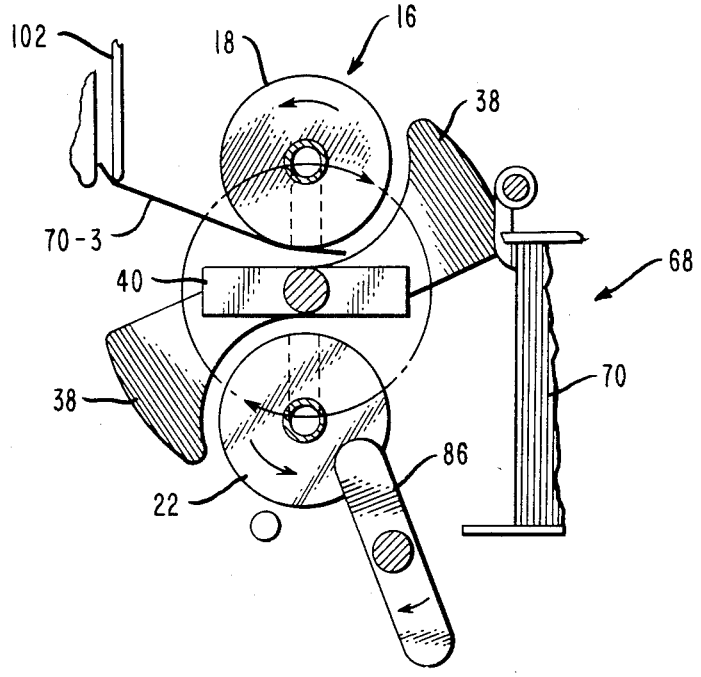

Referring now particularly to FIGS. 6E to 6H, the pick-up wheel assembly 16 continues to be driven by the drive shaft 11 in a clockwise direction with each of the pick-up wheels 18 and 22 rotating in a counterclockwise direction. As shown in FIG. 6E, during an initial part of a loading operation the openings 25 in the pair of pick-up wheels 18 come into engagement with the currency note 70-3 which is to be loaded into the cassette 68, the leading edge of this note being supported on the shoulders 116 of the pinch rollers 114; the other pair of pick-up wheels 22 is in engagement with the first note 70-4 of the stack of notes 70 in the cassette 68. As has been explained previously, at this time vacuum is applied to the openings 25 in the pick-up wheels 18, and so continued rotation of the assembly 16 and the pick-up wheels 18 serves to draw the leading end of the note 70-3 away from the pinch rollers 114 as shown in FIG. 6F. As the other pair of pick-up wheels 22 moves out of engagement with the first note 70-4 in the cassette 68, the note engaging ends of the pawls 74 come into engagement with the note 70-4 so as to retain the stack of notes 70 in position. As the pick-up wheel assembly 16 continues to rotate, the pick-up wheels 18 draw the note 70-3 out of the guideway 102, the note 70-3 passing between the guide plate 40 and the guide members 38 on one side of the note and the pick-up wheels 18 and the guide rollers 36 (FIG. 1) on the other side of the note, as shown in FIG. 6G.

During a final part of a loading operation, the pawls 74 are pivoted out of engagement with the first note 70-4 in the cassette 68 so as to enable the pick-up wheels 18 to bring the leading edge of the note 70-3 into position in the cassette next to the note 70-4, as shown in FIG. 6H. Immediately after the note 70-3 has been so positioned, the application of vacuum to the pick-up wheels 18 is discontinued so as to enable the pick-up wheels 18 to disengage from, and commence to move away from, the note 70-3, whereupon the pawls 74 are pivoted so as to bring their note-engaging ends into engagement with the note 70-3. At the same time as the leading edge of the note is being positioned next to the note 70-4, the rotating paddle members 86 engage the trailing edge of the note 70-3 so as to urge this trailing edge against the corresponding edge of the note 70-4, thereby completing the loading of the note 70-3 into the cassette 68. It will be appreciated that the note 70-3 has been rotated through 180° from its position shown in FIG. 6E when it was first engaged by the pickup wheels 18. Immediately after the application of vacuum to the pick-up wheels 18 is discontinued, vacuum is applied to the openings 25 of the pick-up wheels 22, as a result of the opening 48 (FIG. 3) moving into communication with the arcuate slot 54. At this time the openings 25 of the pick-up wheels 22 are in engagement with the next note 70-5 (FIG. 6H) to be loaded into the cassette 68, the leading edge of this note being supported on the shoulders 116 of the pinch rollers 114. The note 70-5 is then drawn out of the guideway 102 by the pick-up wheels 22 and carried to, and loaded into, the cassette 68 in a similar manner to that described above in relation to the note 70-3.

Figure 7:
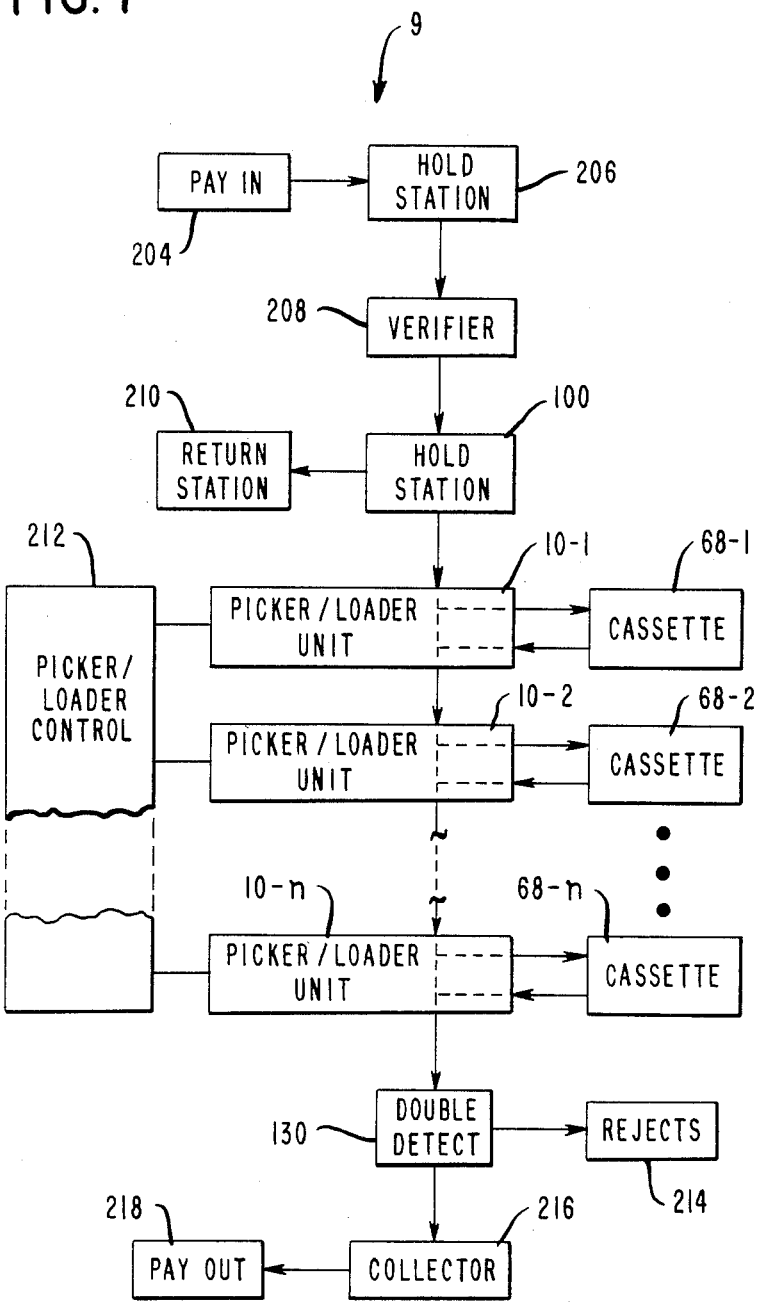
FIG. 7 is a schematic block diagram of an automatic bank teller machine incorporating a plurality of picker/-loader units and associated cassettes.

Referring now particularly to FIG. 7, a plurality of picker/loader units 10-1, 10-2 . . . **10-*n*, similar to the picker/loader mechanism 10 described above, is used in an automatic bank teller machine, the units being arranged one above the other and being respectively associated with a plurality of cassettes 68-1, 68-2 . . . 68-*n*. The automatic teller machine can operate either in a paying-in mode or in a paying-out mode. During a paying-in operation, currency notes are inserted by a customer into the machine at a paying-in station 204 from where the notes are fed to a hold station 206. Next, the notes are fed to a currency verifier station 208 which serves to count the notes and to check the genuineness and denomination of each of the notes. From the verifier station 208 the notes are fed to the hold station 100, and any notes rejected by the machine, or any excess notes inserted by mistake into the machine, are directed to a currency note return station 210**.

The operation of the picker/loader units 10-1 to **10-*n* is controlled by control means 212. During a paying-in operation of the machine, prior to each accepted note reaching the first picker/loader unit 10-1, the control means 212 causes the gate members (106 in FIG. 1) of a selected one of the picker/loader units to be set to positions directing notes into the upper guideway (102 in FIG. 2) of the selected unit and also sets the selected picker/loader unit to operate in a loading mode by energization, if necessary, of the operation mode control solenoid 138 (FIGS. 4 and 5); the gate members (like 106) of any picker/loader unit above the selected unit are set to a cassette bypass condition. If the first picker/loader unit 10-1 is selected, then the accepted note is loaded into the associated cassette 68-1; if some other picker/loader unit is selected, then the accepted note travels from the first (top) picker/loader unit 10-1 towards the last (bottom) picker/loader unit 10-*n* until it reaches the selected picker/loader unit, this selected unit serving to load the note into the associated cassette like 68-*n*. It will be appreciated that by virtue of this arrangement, currency notes of different denominations can be loaded into different cassettes. Also, two or more of the cassettes 68-1 to 68-*n*** can be used to store notes of the same denomination. Each cassette is provided with in-built sensing means (not shown) serving to generate a first indicating signal when the cassette is approaching a full condition, and a second indicating signal when the cassette is empty.

During a paying-out operation of the automatic bank teller machine, one or more of the picker/loader units 10-1 to **10-*n* are selected in turn by the control means 212, the (or each) selected picker/loader unit being set to a pick-up mode of operation by energization, if necessary, of the operation mode control solenoid 138 (FIGS. 4 and 5), and the gate members (106 in FIG. 1) of any picker/loader unit subsequent to the selected unit being set to the cassette bypass condition. Thus, a selected one of the picker/loader units 10-1 to 10-*n* picks currency notes one at a time from the associated cassette and feeds them into its lower guideway (120 in FIG. 2) and from there these notes are fed directly by any subsequent picker/loader unit or units to the double detect device 130 (FIG. 7). The double detect device 130 serves to detect if two superposed notes are fed to it, and if it does detect superposed notes, it directs these notes to a reject station 214. Single notes passed by the double detect device 130 are fed to a note collector station 216, and from there the notes are fed to a paying-out station 218** where they can be collected by the customer.

It should be understood that the automatic bank teller machine described above also includes various conventional features not shown in FIG. 7. For example, the machine includes means for accepting and returning a customer identifying card, means for manually entering into the machine certain data such as personal identification number, amount of cash required or to be paid in, and type of transaction, data processing means for processing manually entered data and data read from a card and for updating a customer's account, and printing means for printing and issuing a transaction record slip.

The sheet handling apparatus 9 described above could also be used in a checkout system, the apparatus being used, in conjunction with a note verifying device, to accept currency notes paid in by a customer and also to pay out notes as change.

I claim:

1. A sheet handling apparatus comprising:

holding means for holding a stack of sheets;

a release station;

a loading station;

pick-up means being moveable into engagement with a first sheet in said stack at one end of said holding means for the purpose of removing a said sheet from said stack; said pick-up means also being moveable into engagement with a sheet located at said loading station for the purpose of loading sheets one by one into said holding means at said one end;

mode selection means for selecting whether said sheet handling apparatus is to operate in a sheet pick-up mode or a sheet-loading mode; and control means responsive to said mode selection means for controlling the operation of said pick-up means to pick up a first said sheet in said stack and release it at said release station when said sheet handling apparatus is operated in said sheet pick-up mode, and also for controlling the operation of said pick-up means to pick up a sheet at said loading station and release it at said one end of said holding means when said sheet handling apparatus is operated in said sheet-loading mode;

said pick-up means being vacuum operated, and said control means being effective to control the application of vacuum to said pick-up means;

said pick up means including a rotatable assembly of vacuum operated pick-up members arranged to move in a planetary manner; each said pick-up member being arranged to rotate in a direction which is opposite to the direction of rotation of said assembly and being arranged to make rolling contact with a sheet when picking up a said sheet from said holding means.

2. The sheet handling apparatus as claimed in claim 1, in which said rotatable assembly also comprises a hollow shaft for each said pick-up member with each said hollow shaft having an opening in its circumference for connection to a source of vacuum, whereby vacuum is applied to a said opening of a said hollow shaft when the associated said pick-up member is picking up a said sheet from said holding means, and the application of said vacuum is discontinued when said last named pick-up member is releasing said sheet at said release station.

3. The sheet handling apparatus as claimed in claim 1 in which said rotatable assembly includes first and second of said pick-up members which are positioned thereon to make simultaneous contact with a said sheet when picking up a sheet, and said rotatable assembly also includes third and fourth of said pick-up members which are angularly displaced from said first and second pick up members and also are positioned on said rotatable assembly to make simultaneous contact with a said sheet when picking up a sheet.

4. The sheet handling apparatus as claimed in claim 3 in which said first and second pick-up members form a first pair of pick-up members and said third and fourth pick-up members form a second pair of pick-up members;

said holding means and said release station being positioned in said apparatus so that when said apparatus is operated in said sheet pick-up mode, one of said first and second pairs of pick-up members is positioned at said holding means to pick up a said sheet therefrom and the remaining one of said pairs of pick-up members is positioned at said release station for releasing a sheet thereat; and said loading station and said holding means being positioned in said apparatus so that when said apparatus is operated in said sheet-loading mode, one of said first and second pairs of pick-up members is positioned at said loading station for picking up a said sheet and the remaining one of said pairs is positioned at said holding means for releasing a said sheet thereat.

5. The sheet handling apparatus as claimed in claim 1 in which each of said pick-up members is in the form of a wheel.

6. The sheet handling apparatus as claimed in claim 5 in which said pick-up means includes means for rotating said rotatable assembly through 180 degrees when a said sheet is moved from said loading station to said holding means.

7. The sheet handling apparatus as claimed in claim 6 in which said holding means includes moveable sheet retaining means for engaging a first said sheet of said stack for retaining said stack in said holding means while said pick-up means is out of engagement with said first sheet.

8. The sheet handling apparatus as claimed in claim 7, in which said sheet retaining means comprises a plurality of pawls arranged to engage an edge portion of said first sheet.

9. The sheet handling apparatus as claimed in claim 1 in which said holding means includes a sheet retaining member arranged to engage a first said sheet of the stack during said sheet pick-up mode of operation of said apparatus and also to be positioned out of engagement with said first sheet during said loading mode of operation of said apparatus, said mode selection means having means to move said sheet retaining member into and out of engagement with said first sheet.

10. The sheet handling apparatus as claimed in claim 7 in which said holding means includes a rotatable sheet support means positioned at said holding means and arranged, under the control of said mode selection means, to rotate continuously during said sheet-loading mode of operation of said apparatus and to be held stationary during a said pick-up mode of operation of said apparatus, said rotatable sheet support means serving, when rotating, to feed a said sheet released at said holding means away from said pick-up means and serving, when stationary, to support a said sheet immediately prior to the sheet being picked up by said pick-up means.

11. The sheet handling apparatus as claimed in claim 10 in which said rotatable sheet support means include paddle means arranged, during a said loading mode of operation of said apparatus, to rotate continuously and to engage a trailing edge of a said sheet being loaded into said holding means for the purpose of urging said trailing edge into said holding means.

12. A currency note handling system comprising:

a pay-in station for receiving currency notes when said system is operated in a pay-in mode;

a pay-out station for dispensing currency notes when said system is operated in a pay-out mode;

at least one cassette for storing a stack of said notes; said cassette having an open end and said stack of notes touching one another in said cassette;

a note-handling apparatus being associated with each said cassette;

each said note handling apparatus having a pick-up means for transferring a said note from said open end of the associated said cassette to said pay-out station when said system is operated in said pay-out mode and also for transferring a said note received at said pay-in station to said open end of said cassette when said system is operated in said pay-in mode;

said pick up means including a rotatable assembly of vacuum operated pick-up members arranged to move in a planetary manner; each said pick-up member being arranged to rotate in a direction which is opposite to the direction of rotation of said assembly and being arranged to make rolling contact with a note when picking up a said note from said open end; and means for controlling whether said system is operated in said pay-in mode or said pay-out mode.

13. The system as claimed in claim 12 having a plurality of said cassettes and a plurality of said note handling apparatuses, each said note handling apparatus further comprising:

a release station;

a loading station; and mode selection means for selecting whether the associated said note handling apparatus is to operate in a note pick-up mode or a note loading mode;

said system also having means for connecting the loading station of each said note handling apparatus with said pay-in station and also for connecting the release station of each said note handling apparatus with said pay-out station;

said controlling means being effective to control the loading of a note received at said pay-in station to a said cassette of a selected one of said note handling apparatuses when said system is operated in a pay-in mode, and said controlling means also being effective to control the dispensing of a note from a selected one of said cassettes to said pay-out station when said system is operated in a pay-out mode.

14. A currency note handling system as claimed in claim 13, in which said plurality of note handling apparatuses are arranged in series, with currency notes being supplied to a first apparatus of said series when said system is operated in a pay-in mode, and also with currency notes being supplied from the last apparatus of said series when said system is operated in a pay-out mode; said connecting means including for each said apparatus a gate means settable to a cassette loading position in which the gate means serve to direct incoming notes to the associated loading station and also settable to a cassette bypass position in which the gate means serve to cause incoming notes to bypass the associated cassette and to be directed to the next said note handling apparatus, if any, of said series.

* * * * *